US011158928B2

(12) United States Patent
Park et al.

(10) Patent No.: US 11,158,928 B2
(45) Date of Patent: Oct. 26, 2021

(54) CHIP ANTENNA MODULE

(71) Applicant: Samsung Electro-Mechanics Co., Ltd., Suwon-si (KR)

(72) Inventors: Ju Hyoung Park, Suwon-si (KR); Myeong Woo Han, Suwon-si (KR); Jae Yeong Kim, Suwon-si (KR); Young Sik Hur, Suwon-si (KR); Sung Yong An, Suwon-si (KR); Dae Ki Lim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 72 days.

(21) Appl. No.: 16/803,243

(22) Filed: Feb. 27, 2020

(65) Prior Publication Data

US 2021/0151853 A1 May 20, 2021

(30) Foreign Application Priority Data

Nov. 20, 2019 (KR) ..... 10-2019-0149273

(51) Int. Cl.
*H01Q 1/22* (2006.01)
*H01Q 1/24* (2006.01)
(Continued)

(52) U.S. Cl.
CPC ..... *H01Q 1/2283* (2013.01); *H01Q 1/243* (2013.01); *H01Q 9/045* (2013.01); *H01Q 21/065* (2013.01)

(58) Field of Classification Search
CPC .... H01Q 1/2283; H01Q 1/243; H01Q 21/065; H01Q 9/045; H01Q 21/28; H01Q 21/08;
(Continued)

(56) References Cited

U.S. PATENT DOCUMENTS

2006/0044191 A1 3/2006 Harihara
2016/0211585 A1* 7/2016 Chau ..... H01Q 21/062
(Continued)

FOREIGN PATENT DOCUMENTS

JP 2006-050340 A 2/2006
KR 10-1174739 B1 8/2012
(Continued)

OTHER PUBLICATIONS

Korean Office Action dated Oct. 14, 2020, in the counterpart of Korean Patent Application No. 10-2019-0149273, (5 pages in English) (4 pages in Korean).

*Primary Examiner* — Don P Le
(74) *Attorney, Agent, or Firm* — NSIP Law

(57) ABSTRACT

A chip antenna module includes a first dielectric layer; a solder layer disposed on a first surface of the first dielectric layer; a patch antenna pattern disposed on a second surface of the first dielectric layer; a coupling pattern disposed on the second surface of the first dielectric layer, and spaced apart from the patch antenna pattern without overlapping the patch antenna pattern in a thickness direction; a first feed via extending through the first dielectric layer in the thickness direction so as not to overlap the patch antenna pattern and the coupling pattern in the thickness direction; a first feed pattern extending from a first end of the first feed to overlap at least a portion of the coupling pattern; and a second feed pattern extending from a second end of the first feed via to overlap at least a portion of the coupling pattern.

16 Claims, 13 Drawing Sheets

(51) Int. Cl.
*H01Q 21/06* (2006.01)
*H01Q 9/04* (2006.01)

(58) Field of Classification Search
CPC ... H01Q 9/0457; H01Q 21/061; H01Q 9/0407
USPC ..... 343/700 R
See application file for complete search history.

(56) References Cited

U.S. PATENT DOCUMENTS

| | | | | |
|---|---|---|---|---|
| 2017/0250466 | A1* | 8/2017 | Schlaffer | H05K 1/185 |
| 2020/0014113 | A1 | 1/2020 | Asaka | |
| 2020/0328518 | A1* | 10/2020 | Park | H01Q 1/2283 |
| 2021/0151853 | A1* | 5/2021 | Park | H01Q 21/065 |
| 2021/0151899 | A1* | 5/2021 | Park | H01Q 21/065 |
| 2021/0175609 | A1* | 6/2021 | Ryoo | H01Q 9/0414 |

FOREIGN PATENT DOCUMENTS

| | | | |
|---|---|---|---|
| KR | 10-1494687 | B1 | 2/2015 |
| WO | WO 2018/111690 | A1 | 6/2018 |
| WO | WO 2018/173750 | A1 | 9/2018 |

* cited by examiner

CHIP ANTENNA MODULE

CROSS-REFERENCE TO RELATED APPLICATION(S)

This application claims the benefit under 35 USC § 119(a) of Korean Patent Application No. 10-2019-0149273 filed on Nov. 20, 2019 in the Korean Intellectual Property Office, the entire disclosure of which is incorporated herein by reference for all purposes.

BACKGROUND

1. Field

The following description relates to a chip antenna module.

2. Description of Background

Data traffic for mobile communications is increasing rapidly every year. Technological development is underway to support the transmission of such rapidly increased data in real time in wireless networks. For example, the contents of internet of things (IoT) based data, augmented reality (AR), virtual reality (VR), live VR/AR combined with SNS, autonomous navigation, applications such as Sync View (real-time video user transmissions using ultra-small cameras), and the like may require communications (e.g., 5G communications, mmWave communications, etc.) supporting the transmission and reception of large amounts of data.

Millimeter wave (mmWave) communications, including 5th generation (5G) communications, have been researched, and research into the commercialization/standardization of an antenna module for smoothly realizing such communications is progressing.

Since radio frequency (RF) signals in high frequency bands (e.g., 24 GHz, 28 GHz, 36 GHz, 39 GHz, 60 GHz, etc.) are easily absorbed and lost in the course of the transmission thereof, the quality of communications may be dramatically reduced. Therefore, antennas for communications in high frequency bands may require different approaches from those of conventional antenna technology, and a separate approach may require further special technologies, such as implementing separate power amplifiers for securing antenna gain, integrating an antenna and radio frequency integrated circuit (RFIC), securing effective isotropic radiated power (EIRP), and the like.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, a chip antenna module includes a first dielectric layer; a solder layer disposed on a first surface of the first dielectric layer; a patch antenna pattern disposed on a second surface of the first dielectric layer; a coupling pattern disposed on the second surface of the first dielectric layer, and spaced apart from the patch antenna pattern without overlapping the patch antenna pattern in a thickness direction of the chip antenna module; a first feed via extending through the first dielectric layer in the thickness direction so as not to overlap the patch antenna pattern and the coupling pattern in the thickness direction; a first feed pattern extending from a first end of the first feed via to overlap at least a portion of the coupling pattern in the thickness direction; and a second feed pattern extending from a second end of the first feed via to overlap at least a portion of the coupling pattern in the thickness direction.

The coupling pattern may extend in a first direction, and the first feed pattern may extend from the first end of the first feed via in a second direction that is different from the first direction.

The second feed pattern may extend from the second end of the first feed via in the second direction.

A length of the first feed pattern in the second direction may be greater than a length of the coupling pattern in the first direction.

The first feed pattern may overlap a portion of the patch antenna pattern in the thickness direction.

The chip antenna module may include a detour pattern disposed coplanar with the second feed pattern or offset from the second feed pattern along the thickness direction, electrically connected to the second feed pattern, and having a shape that rotates around a point.

The second surface of the first dielectric layer may have a polygonal shape, and the patch antenna pattern may have a polygonal shape in which at least some sides of the patch antenna pattern are oblique with respect to each side of the second surface of the first dielectric layer.

The patch antenna pattern may have a polygonal shape in which at least some sides of the patch antenna pattern are oblique with respect to each side of the second surface of the first dielectric layer.

The first feed pattern may extend in a direction that is oblique with respect to each side of the second surface of the first dielectric layer.

The chip antenna module may include a second dielectric layer disposed on the second surface of the first dielectric layer; and a third dielectric layer disposed on a surface of the second dielectric layer opposite to the first dielectric layer. The patch antenna pattern may include a first patch antenna pattern disposed between the first dielectric layer and the third dielectric layer; and a second patch antenna pattern disposed on a surface of the third dielectric layer opposite to the second dielectric layer.

The chip antenna module may include a second feed via that passes through the first dielectric layer and is configured to provide an electricity feed path for the second patch antenna pattern; and shielding vias that pass through the first dielectric layer, are electrically connected to the first patch antenna pattern, and surround the second feed via. The first patch antenna pattern may define a through-hole through which the second feed via passes, and is fed from the first feed pattern.

In another general aspect, a chip antenna module includes a first dielectric layer; a solder layer disposed on a first surface of the first dielectric layer; a second dielectric layer disposed on a second surface of the first dielectric layer; a third dielectric layer disposed on a surface of the second dielectric layer opposite to the first dielectric layer; a first patch antenna pattern disposed between the first dielectric layer and the third dielectric layer, and having a through-hole; a second patch antenna pattern disposed on a surface of the third dielectric layer opposite to the first dielectric layer; a second feed via that passes through the first dielectric layer and through the through-hole of the first patch antenna pattern, and is configured to provide an electricity feed path to the second patch antenna pattern; shielding vias that pass through the first dielectric layer, are electrically connected to the first patch antenna pattern, and surround the second feed via; a coupling pattern disposed on the second surface of the first dielectric layer, and spaced apart from the first patch antenna pattern without overlapping the first patch antenna pattern in a thickness direction of the chip antenna module; and a first feed via extending through the first dielectric layer in the thickness direction, and configured to provide an electricity feed path for the coupling pattern.

The coupling pattern may be disposed closer to a side surface of the first dielectric layer than the first patch antenna pattern.

The second surface of the first dielectric layer may have a polygonal shape, the first patch antenna pattern may have a polygonal shape in which at least some sides of the first patch antenna pattern are oblique with respect to each side of the second surface of the first dielectric layer, and the coupling pattern may be disposed closer to a corner of the first dielectric layer than the first patch antenna pattern.

The coupling pattern may extend in a direction that is oblique with respect to each side of the second surface of the first dielectric layer.

The coupling pattern may not to overlap the second patch antenna pattern in the thickness direction, and a dielectric constant of the second dielectric layer may be lower than a dielectric constant of the first dielectric layer and a dielectric constant of the third dielectric layer.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
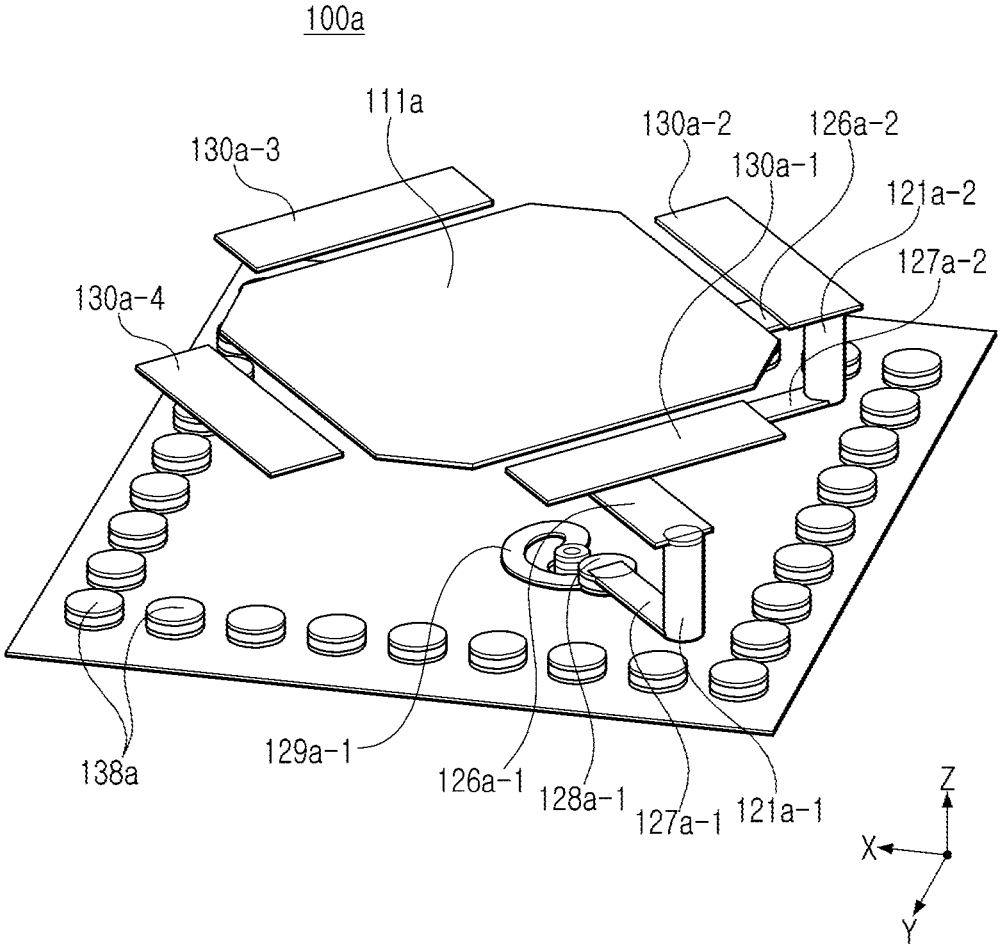
FIGS. 1A, 1B, and 1C are perspective views illustrating a chip antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
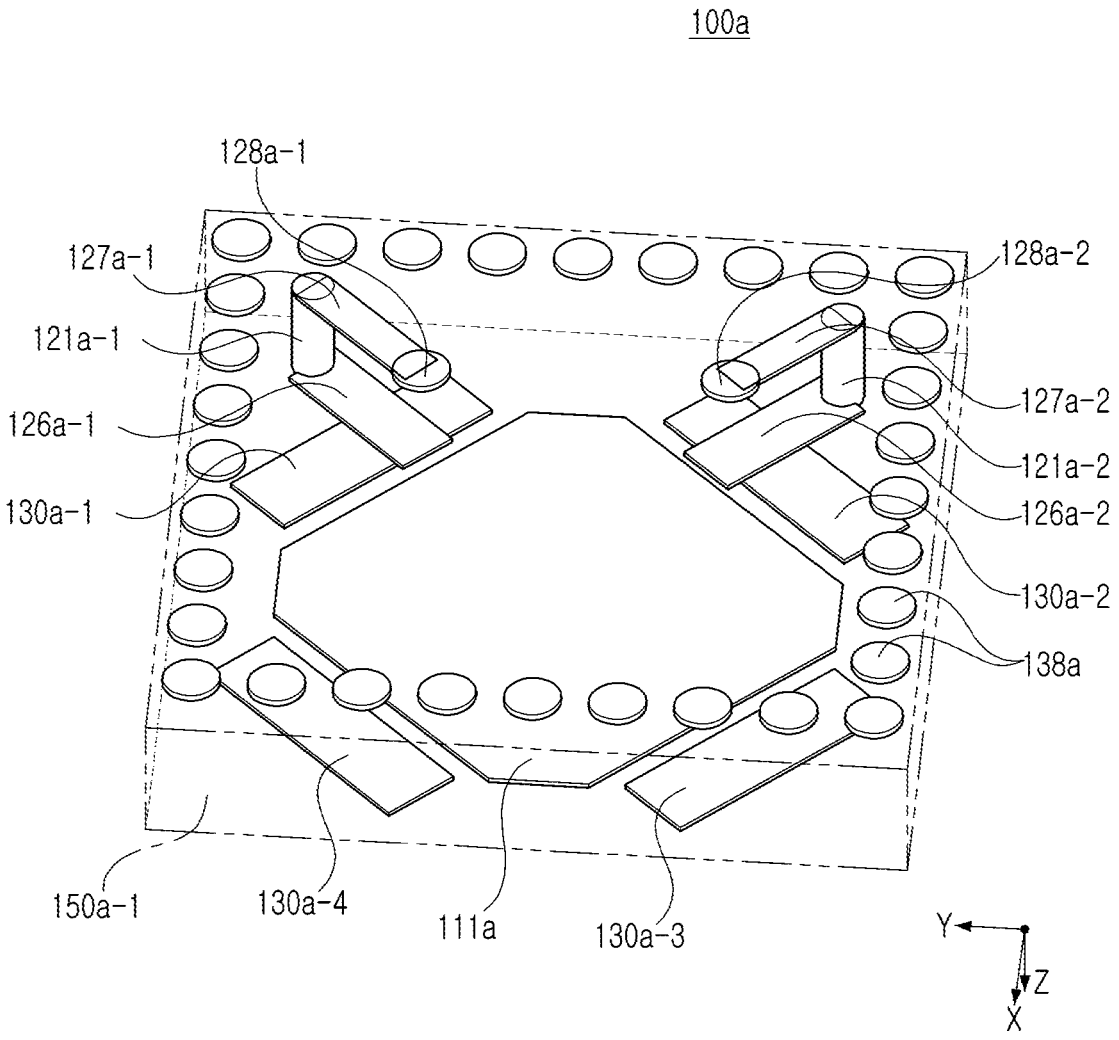
Figure 1C:
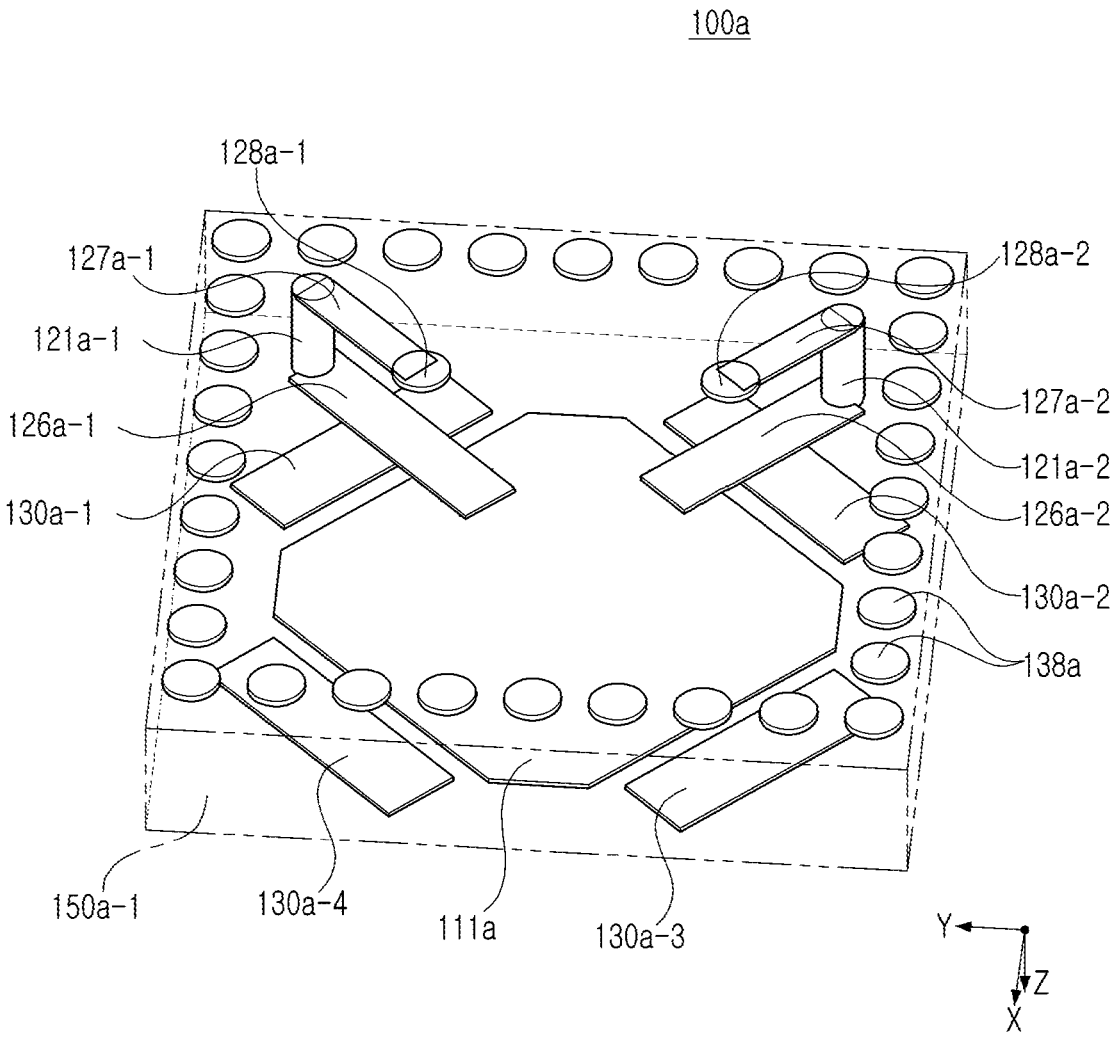

FIGS. 1A, 1B, and 1C are perspective views illustrating a chip antenna module according to an example.

Referring to FIGS. 1A and 1B, a chip antenna module 100*a* according to an example may include a first dielectric layer 150*a*-1, a solder layer 138*a*, a first patch antenna pattern 111*a*, a coupling pattern 130*a*-1, 130*a*-2, 130*a*-3, and/or 130*a*-4, a first feed via 121*a*-1 and/or 121*a*-2, a first feed pattern 126*a*-1 and/or 126*a*-2, and a second feed pattern 127*a*-1 and/or 127*a*-2.

An upper surface of the first dielectric layer 150*a*-1 may be used as an arrangement space of the first patch antenna pattern 111*a*, and a lower surface of the first dielectric layer 150*a*-1 may be used as an arrangement space of the solder layer 138*a*.

The first dielectric layer 150*a*-1 may serve as a propagation path of a radio frequency (RF) signal radiated through a lower surface of the first patch antenna pattern 111*a*. The RF signal may have a wavelength, corresponding to a dielectric constant of the first dielectric layer 150*a*-1, in the first dielectric layer 150*a*-1.

A distance between the first patch antenna pattern 111*a* and the solder layer 138*a* may be optimized based on the wavelength of the RF signal, and may be easily shortened as the wavelength is shortened. Therefore, a thickness of the first dielectric layer 150*a*-1 in a vertical direction (e.g., a z direction) may be easily thinned as the dielectric constant of the first dielectric layer 150*a*-1 is increased.

A size of each of the first patch antenna pattern 111*a* and the solder layer 138*a* in a horizontal direction (e.g., an x direction and/or a y direction) may be optimized based on the wavelength of the RF signal, and may be easily reduced as the wavelength is shortened. Therefore, a size of the first dielectric layer 150*a*-1 in the horizontal direction (e.g., the x direction and/or the y direction) may be easily reduced as the dielectric constant of the first dielectric layer 150*a*-1 is increased.

Therefore, an overall size of the chip antenna module 100*a* may be easily reduced as the dielectric constant of the first dielectric layer 150*a*-1 is increased.

In general, patch antennas may be implemented as a portion of a substrate, such as a printed circuit board (PCB), but miniaturization of the patch antennas may encounter limitations due to a relatively low dielectric constant of the typical insulating layer of the printed circuit board (PCB).

Since the chip antenna module 100*a* may be manufactured separately for a substrate such as a printed circuit board (PCB), the chip antenna module 100*a* may easily use the first dielectric layer 150*a*-1 having a higher dielectric constant than that of a general insulating layer of the printed circuit board (PCB).

For example, the first dielectric layer 150*a*-1 may include a ceramic material configured to have a dielectric constant higher than that of the general insulating layer of the printed circuit board (PCB).

For example, the first dielectric layer 150*a*-1 may be formed of a material having a relatively high dielectric constant, such as a ceramic-based material, a low temperature co-fired ceramic (LTCC), or a glass-based material, and may be configured to have a relatively high dielectric constant and relatively strong durability by further containing at least one of magnesium (Mg), silicon (Si), aluminum (Al), calcium (Ca), and titanium (Ti). For example, the first dielectric layer 150*a*-1 may include any one or any combination of any two or more of $Mg_2SiO_4$, $MgAlO_4$, and $CaTiO_3$.

For example, the first dielectric layer 150*a*-1 may have a structure in which each of a plurality of dielectric layers are stacked. Spaces between the plurality of dielectric layers may be used as arrangement spaces of the first feed pattern 126*a*-1 or 126*a*-2 and/or the second feed pattern 127*a*-1 or 127*a*-2, and, in the spaces between the plurality of dielectric layers, spaces in which the first feed pattern 126*a*-1 or 126*a*-2 and/or the second feed pattern 127*a*-1 or 127*a*-2 are not disposed may be filled with an adhesive material (e.g., a polymer).

The solder layer 138*a* may be configured to support mounting of a connection member of the chip antenna module 100*a*. For example, the solder layer 138*a* may be more easily bonded to the connection member, as the solder layer 138*a* is disposed along an edge of the first dielectric layer 150*a*-1. For example, the solder layer 138*a* may be configured to be advantageous for bonding to a tin (Sn)-based solder having a relatively low melting point, and may be configured to be easily bonded to the solder by including a tin plating layer and/or a nickel plating layer.

In addition, the solder layer 138*a* may have a structure in which a plurality of cylinders is arranged to efficiently support mounting of the connection member of the chip antenna module 100*a*.

The first patch antenna pattern 111*a* may be fed for electricity from the first feed via 121*a*-1 or 121*a*-2, the first feed pattern 126*a*-1 or 126*a*-2, and the second feed pattern 127*a*-1 or 127*a*-2, and may be configured to transmit and/or receive RF signals.

The wavelength of the RF signal radiated from the first patch antenna pattern 111*a* may correspond to the size of the first patch antenna pattern 111*a* in the horizontal direction (e.g., the x direction and/or the y direction). Therefore, the first patch antenna pattern 111*a* may be configured to form a radiation pattern in the vertical direction (e.g., the z direction) while generating resonance.

For example, the first patch antenna pattern 111*a* may be formed as a conductive paste dried in a state coated and/or filled on the first dielectric layer 150*a*-1.

The coupling pattern 130*a*-1, 130*a*-2, 130*a*-3, or 130*a*-4 may be disposed on an upper surface of the first dielectric layer 150*a*-1, may be disposed so as not to overlap the first patch antenna pattern 111*a* in the vertical direction (e.g., the z direction), and may be disposed to be spaced apart from the first patch antenna pattern 111*a* in the horizontal direction (e.g., in the x direction and/or the y direction).

Since the coupling pattern 130*a*-1, 130*a*-2, 130*a*-3, or 130*a*-4 may be electromagnetically coupled to the first patch antenna pattern 111*a*, impedance that affects resonance frequencies of the first patch antenna pattern 111*a* may be provided.

A bandwidth of the first patch antenna pattern 111*a* may be determined by a combination of a plurality of resonance frequencies, and may be further widened by optimizing a frequency difference between the plurality of resonance frequencies and/or by diversifying the plurality of resonance frequencies.

Therefore, since the coupling pattern 130*a*-1, 130*a*-2, 130*a*-3, or 130*a*-4 provides the impedance to the first patch antenna pattern 111*a*, the bandwidth of the first patch antenna pattern 111*a* may be wider.

The first feed via 121*a*-1 or 121*a*-2 may extend in the first dielectric layer 150*a*-1 in the vertical direction, and may be disposed so as not to overlap the first patch antenna pattern 111*a* and the coupling pattern 130*a*-1, 130*a*-2, 130*a*-3, or 130*a*-4 in the vertical direction.

For example, the first feed via 121*a*-1 or 121*a*-2 may be formed by a process of filling a conductive material (e.g., copper, nickel, tin, silver, gold, palladium, or the like) in a through-hole formed in the first dielectric layer 150*a*-1 using a laser.

The first feed pattern 126*a*-1 or 126*a*-2 may extend from an upper end of the first feed via 121*a*-1 or 121*a*-2, to overlap at least a portion of the coupling pattern 130*a*-1, 130*a*-2, 130*a*-3, or 130*a*-4, on a level lower (in the z direction) than a level of the coupling pattern 130*a*-1, 130*a*-2, 130*a*-3, or 130*a*-4.

Since the first feed pattern 126*a*-1 or 126*a*-2 overlaps the coupling pattern 130*a*-1, 130*a*-2, 130*a*-3, or 130*a*-4 in the vertical direction (for example, the z direction), the first feed pattern 126*a*-1 or 126*a*-2 and the coupling pattern 130*a*-1, 130*a*-2, 130*a*-3, or 130*a*-4 may form first capacitance. Since the coupling pattern 130*a*-1, 130*a*-2, 130*a*-3, or 130*a*-4 is electromagnetically coupled to the first patch antenna pattern 111*a*, the first capacitance may be transferred to the first patch antenna pattern 111*a*.

Therefore, the bandwidth of the first patch antenna pattern 111*a* may be further widened.

For example, the coupling pattern 130*a*-1, 130*a*-2, 130*a*-3, or 130*a*-4 may extend in a first direction, and the first feed pattern 126*a*-1 or 126*a*-2 may have a shape extending from the upper end of the feed via 121*a*-1 or 121*a*-2 in a second direction, different from the first direction. For example, the first direction and the second direction may be perpendicular to each other.

Therefore, since the first capacitance may be easily adjusted according to at least one of a length of the first feed pattern 126*a*-1 or 126*a*-2 in the second direction, a width of the first feed pattern 126*a*-1 or 126*a*-2 in the second direction, and a distance between the first feed pattern 126*a*-1 or 126*a*-2 and the coupling pattern 130*a*-1, 130*a*-2, 130*a*-3, or 130*a*-4 in the second direction, the bandwidth of the first patch antenna pattern 111*a* may be more efficiently widened.

The second feed pattern 127*a*-1 or 127*a*-2 may provide inductance that may affect a resonance frequency of the first patch antenna pattern 111*a*, to the first patch antenna pattern 111*a*. The inductance may be controlled by adjusting a length of the second feed pattern 127*a*-1 or 127*a*-2.

For example, the second feed pattern 127*a*-1 or 127*a*-2 may extend from a lower end of the first feed via 121*a*-1 or 121*a*-2 to overlap at least a portion of the coupling pattern 130*a*-1, 130*a*-2, 130*a*-3, or 130*a*-4, on a level lower than the coupling pattern 130*a*-1, 130*a*-2, 130*a*-3, or 130*a*-4.

When the second feed pattern 127*a*-1 or 127*a*-2 overlaps the coupling pattern 130*a*-1, 130*a*-2, 130*a*-3, or 130*a*-4 in the vertical direction (e.g., the z direction), the first feed pattern 127*a*-1 or 127*a*-2 and the coupling pattern 130*a*-1, 130*a*-2, 130*a*-3, or 130*a*-4 may form second capacitance.

A distance between the second feed pattern 127*a*-1 or 127*a*-2 and the coupling pattern 130*a*-1, 130*a*-2, 130*a*-3, or 130*a*-4 in the vertical direction (e.g., the z direction) may be longer than a distance between the first feed pattern 126*a*-1 or 126*a*-2 and the coupling pattern 130*a*-1, 130*a*-2, 130*a*-3, or 130*a*-4 in the vertical direction (e.g., the z direction). Therefore, the second capacitance may be smaller than the first capacitance.

Since the chip antenna module 100*a* according to an example may relatively easily increase the dielectric constant of the first dielectric layer 150*a*-1, the second capacitance may be larger than capacitance based on a general insulating layer of a substrate such as a printed circuit board (PCB).

Therefore, a chip antenna module 100*a* according to an example may not only use the first capacitance but also the second capacitance.

The lowest frequency of the bandwidth of the first patch antenna pattern 111*a* may be efficiently implemented on the basis of a relatively low resonance frequency based on the first capacitance, and the highest frequency of the bandwidth of the first patch antenna pattern 111*a* may be efficiently implemented on the basis of a relatively high resonance frequency based on the second capacitance.

The second feed pattern 127*a*-1 or 127*a*-2 may have a shape extending from the lower end of the first feed via 121*a*-1 or 121*a*-2 in the second direction. For example, the second feed pattern 127*a*-1 or 127*a*-2, the first feed via 121*a*-1 or 121*a*-2, and the first feed pattern 126*a*-1 or 126*a*-2 may form a U shape. Therefore, since the second capacitance may be easily controlled according to the adjustment in length of the second feed pattern 127*a*-1 or 127*a*-2 in the second direction, the bandwidth of the first patch antenna pattern 111*a* may be more efficiently widened.

Referring to FIGS. 1A, 1B, and 1C, the chip antenna module 100*a* may further include a feed connection structure 128*a*-1/128*a*-2 and a detour pattern 129*a*-1.

The feed connection structure 128*a*-1/128*a*-2 may be connected between the second feed pattern 127*a*-1 or 127*a*-2 and the detour pattern 129*a*-1.

The detour pattern 129*a*-1 may be disposed on the same level as or a level lower than a level of the second feed pattern 127*a*-1 or 127*a*-2, may be electrically connected to the second feed pattern 127*a*-1 or 127*a*-2, and may have a shape that rotates around a point.

The detour pattern 129*a*-1 may provide inductance used for impedance matching of the second feed pattern 127*a*-1 or 127*a*-2, and may provide a relatively large degree of inductance as it has a shape that rotates around one point.

Since the chip antenna module 100*a* may have a smaller size than a general patch antenna, a structure providing inductance used for impedance matching may be intensively designed in the chip antenna module 100*a*.

Since the detour pattern 129*a*-1 has a relatively small size, the inductance used for impedance matching of the chip antenna module 100*a* may be efficiently provided, even when the size of the chip antenna module 100*a* is small.

Referring to FIGS. 1A and 1B, the upper surface of the first dielectric layer 150*a*-1 of the chip antenna module 100*a* may have a polygonal shape, and the first patch antenna pattern 111*a* may have a polygonal shape in which at least some sides of the patch antenna pattern are oblique with respect to each side of the upper surface of the first dielectric layer 150*a*-1.

For example, when each of the upper surface of the first dielectric layer 150*a*-1 and the first patch antenna pattern 111*a* is rectangular, the first patch antenna pattern 111*a* may have a form further rotated 45 degrees from the upper surface of the first dielectric layer 150*a*-1. In other words, when the upper surface of the first dielectric layer 150*a*-1 is square, the first patch antenna pattern 111*a* may be a rhombus.

For example, the coupling pattern 130*a*-1, 130*a*-2, 130*a*-3, or 130*a*-4 may be disposed closer to a corner of the first dielectric layer 150*a*-1 than the patch antenna pattern 111*a*. The coupling pattern 130*a*-1, 130*a*-2, 130*a*-3, or 130*a*-4 may have a shape extending in an oblique direction with respect to each side of the upper surface of the first dielectric layer 150*a*-1. The first feed pattern 126*a*-1 or 126*a*-2 may a shape extending in a direction, oblique with respect to each side of the upper surface of the first dielectric layer 150*a*-1.

Therefore, since the corner of the first dielectric layer 150*a*-1 may provide a relatively wide space in which the conductive component may be disposed, and thus a length of the first feed pattern 126*a*-1 or 126*a*-2 and/or a length of the second feed pattern 127*a*-1 or 127*a*-2 may be more easily longer or more freely designed.

Inductance of the first feed pattern 126*a*-1 or 126*a*-2 and/or inductance of the second feed pattern 127*a*-1 or 127*a*-2 may be larger, as a length of the first feed pattern 126*a*-1 or 126*a*-2 and/or the length of the second feed pattern 127*a*-1 or 127*a*-2 is increased.

The inductance of the first feed pattern 126*a*-1 or 126*a*-2 and/or the inductance of the second feed pattern 127*a*-1 or 127*a*-2 may be provided to the first patch antenna pattern 111*a* by electromagnetic coupling. The first patch antenna pattern 111*a* may have a resonance frequency based on the inductance.

Therefore, a chip antenna module 100*a* according to an example may obtain a more freely controlled bandwidth by using a more freely controlled inductance.

Referring to FIG. 1C, a length of a first feed pattern 126*a*-1 or 126*a*-2 in a second direction may be longer than a length of a coupling pattern 130*a*-1, 130*a*-2, 130*a*-3, or 130*a*-4 in a first direction, and the first feed pattern 126*a*-1 or 126*a*-2 may extend to overlap a portion of a first patch antenna pattern 111*a* in a vertical direction.

Therefore, since capacitance provided to the first patch antenna pattern 111*a* may be further varied, a bandwidth of the first patch antenna pattern 111*a* may be designed more freely.

Figure 2A:
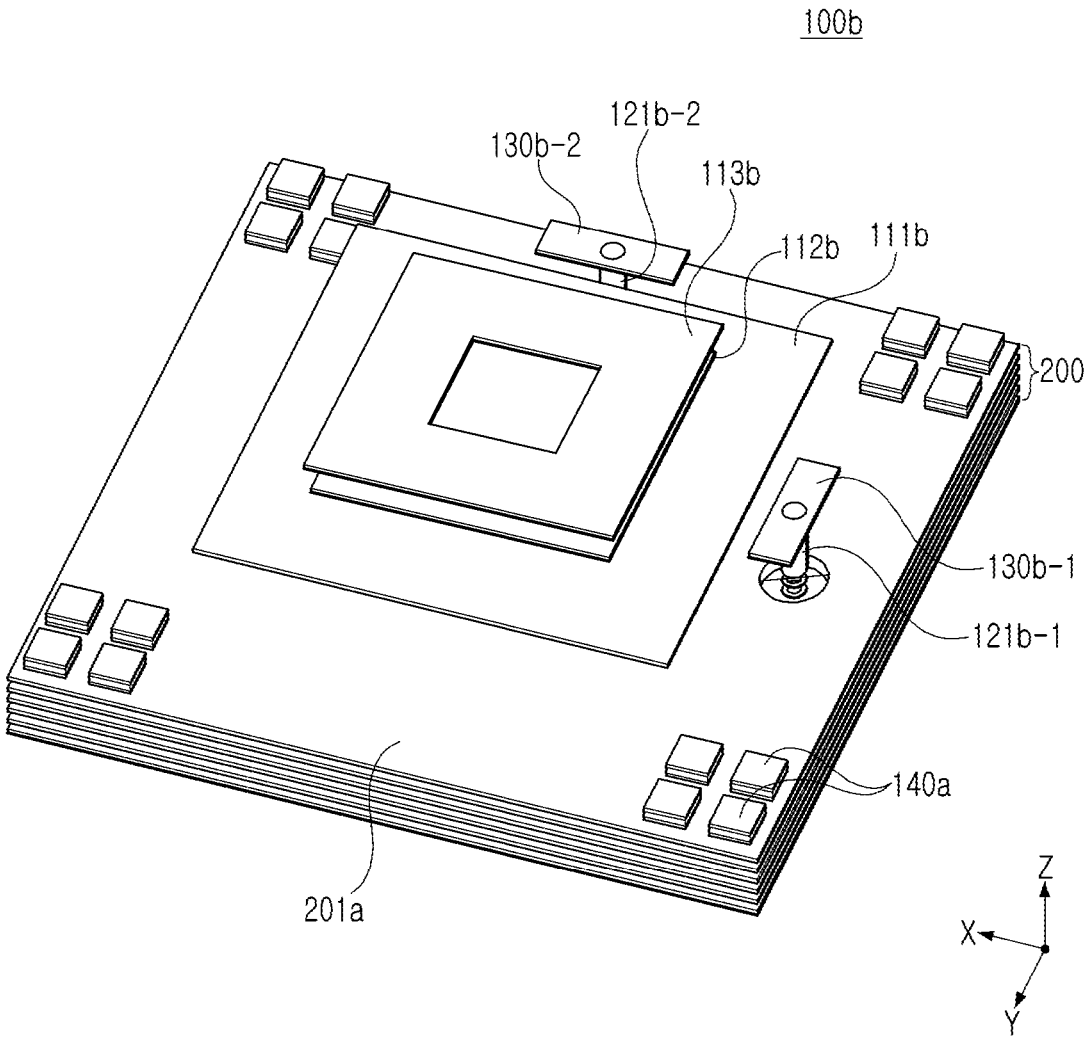
FIG. 2A is a perspective view illustrating a modified structure of a chip antenna module according to an example.
Figure 2B:
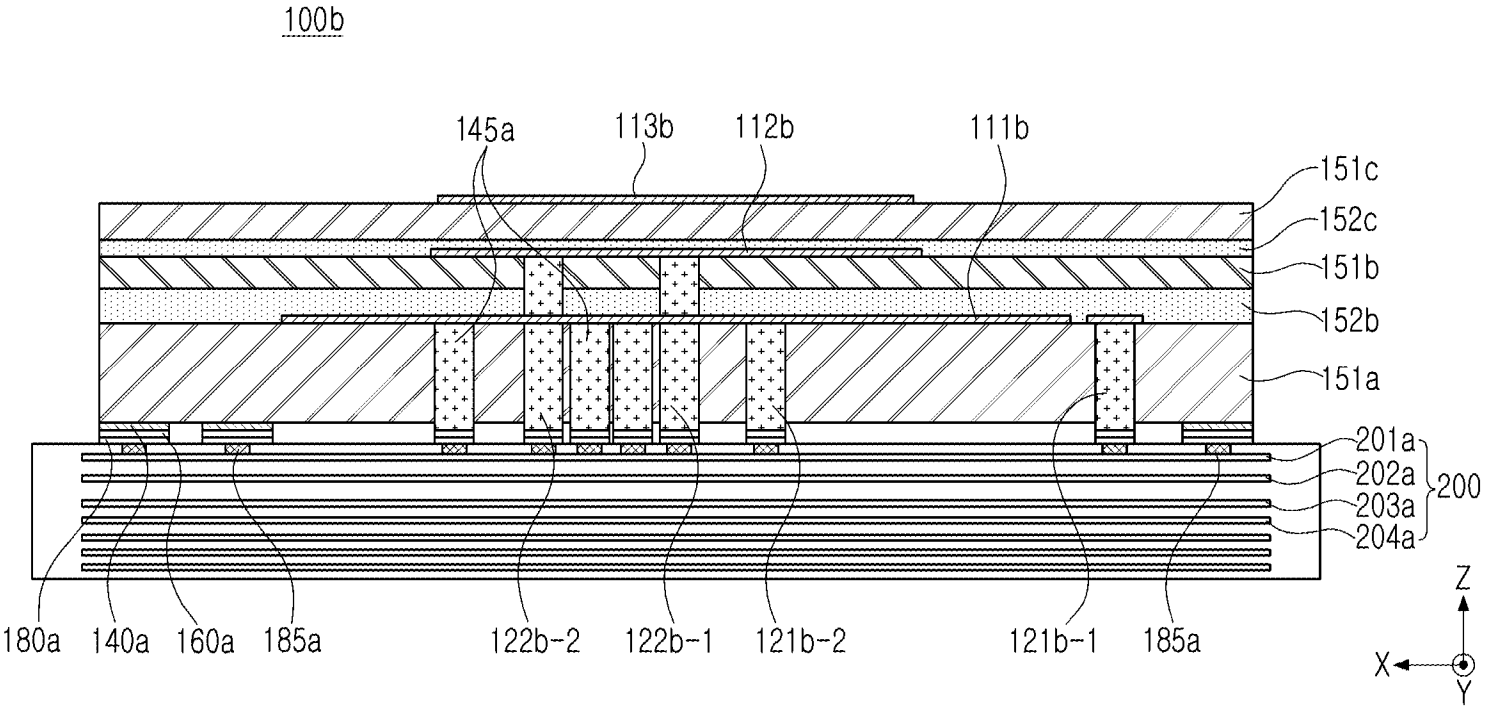
FIG. 2B is a side view illustrating a chip antenna module according to an example.
Figure 3A:
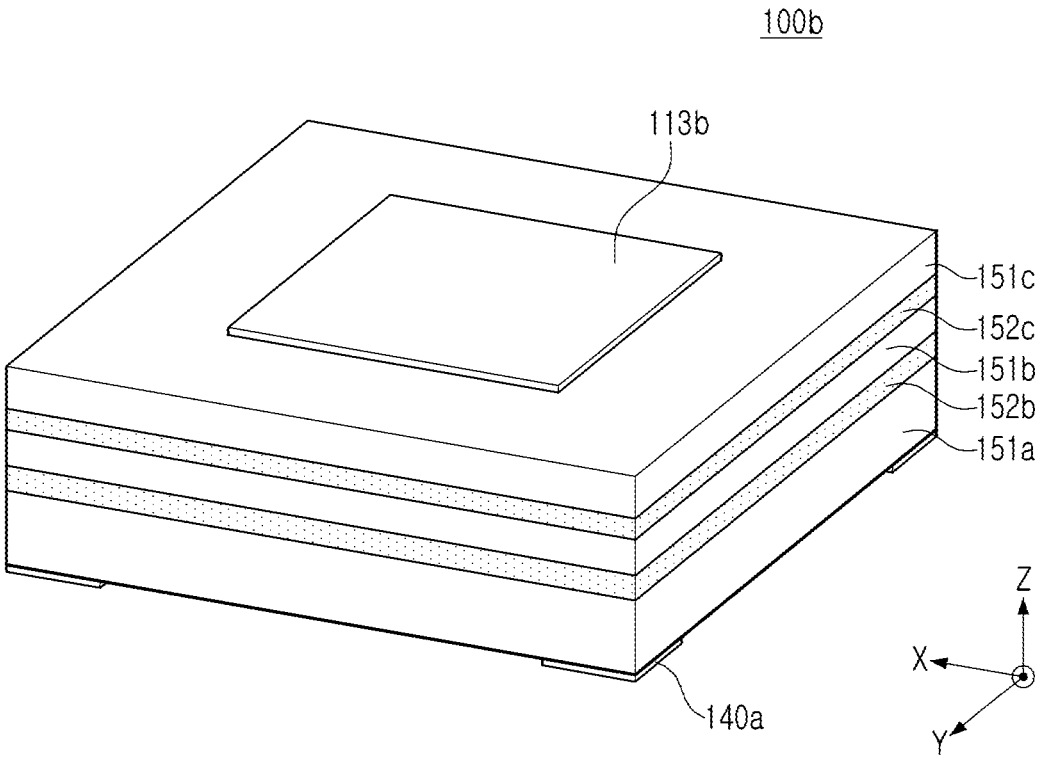
FIG. 3A is a perspective view illustrating an appearance of a chip antenna module according to an example.
Figure 3B:
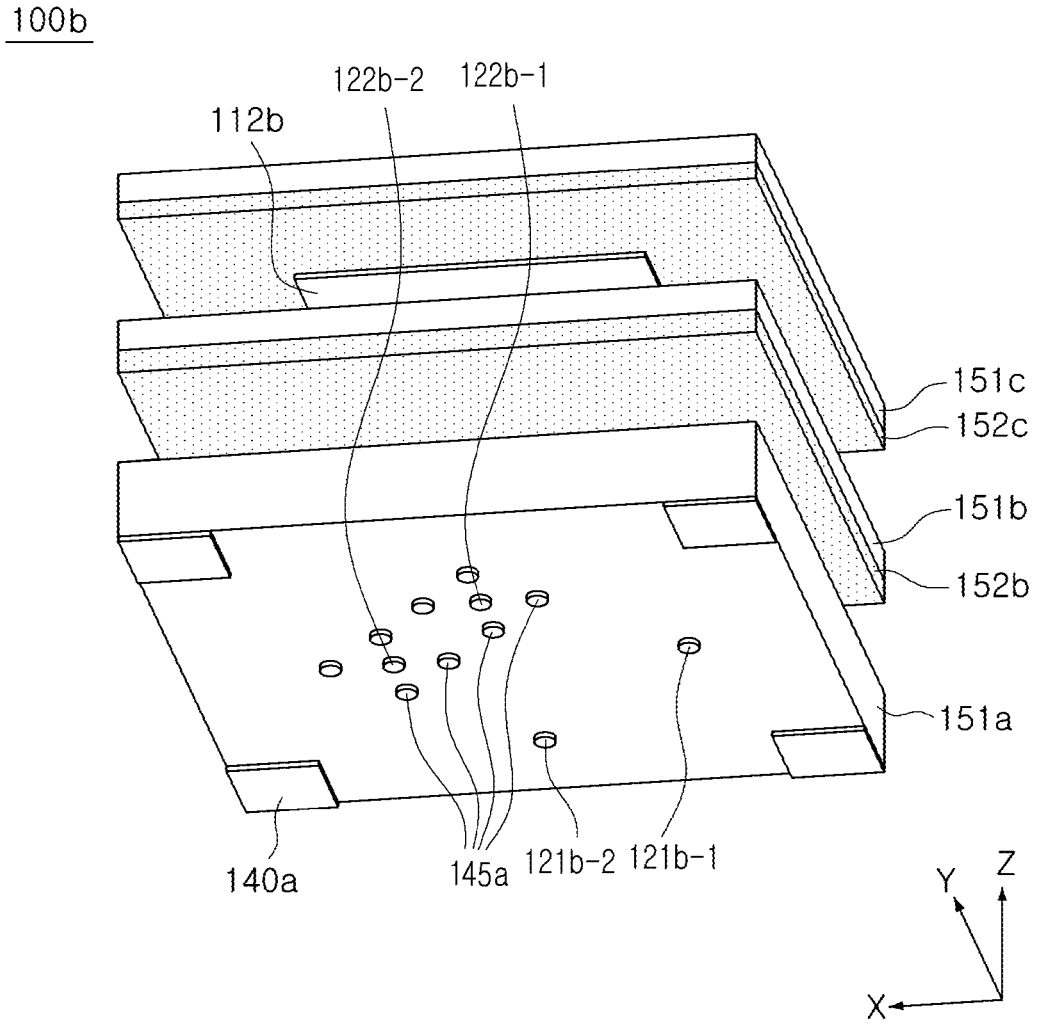
FIG. 3B is a perspective view illustrating a shield via of a chip antenna module according to an example.

FIG. 2A is a perspective view illustrating a modified structure of a chip antenna module according to an example, FIG. 2B is a side view illustrating a chip antenna module according to an example, FIG. 3A is a perspective view illustrating an appearance of a chip antenna module according to an example, and FIG. 3B is a perspective view illustrating a shield via of a chip antenna module according to an example.

Referring to FIGS. 2A, 2B, and 3A, a chip antenna module 100*b* may include a first dielectric layer 151*a*, a solder layer 140*a*, a second dielectric layer 152*b*, a third dielectric layer 151*b*, a fourth dielectric layer 152*c*, a fifth dielectric layer 151*c*, a first patch antenna pattern 111*b*, a second patch antenna pattern 112*b*, a third patch antenna pattern 113*b*, a coupling pattern 130*b*-1 and/or 130*b*-2, and a first feed via 121*b*-1 and/or 121*b*-2, and may be mounted on an upper surface of a first ground plane 201*a* of a connection member 200 through an electrical connection structure 160*a*.

For example, the connection member 200 may have a structure in which first, second, third, and fourth ground planes 201*a*, 202*a*, 203*a*, and 204*a* are alternately stacked between a plurality of insulating layers. A connection member solder layer 180*a* or a peripheral via 185*a* may be further included.

The second dielectric layer 152*b* may be disposed on an upper surface of the first dielectric layer 151*a*, the third dielectric layer 151*b* may be disposed on an upper surface of the second dielectric layer 152*b*, the fourth dielectric layer 152*c* may be disposed on an upper surface of the third dielectric layer 151*b*, and the fifth dielectric layer 151*c* may be disposed on an upper surface of the fourth dielectric layer 152*c*.

For example, the third and fifth dielectric layers 151*b* and 151*c* may include the same material as a material of the first dielectric layer 151*a*, and the second and fourth dielectric layers 152*b* and 152*c* may be formed of the same material.

For example, the second and fourth dielectric layers 152*b* and 152*c* may include materials different from those of the first, third, and fifth dielectric layers 151*a*, 151*b*, and 151*c*. For example, the second and fourth dielectric layers 152*b* and 152*c* may include a polymer having adhesive properties for increasing bonding force between the first, third, and fifth dielectric layers 151*a*, 151*b*, and 151*c*. For example, the second and fourth dielectric layers 152*b* and 152*c* may include ceramic materials having a dielectric constant lower than that of the first, third, and fifth dielectric layers 151*a*, 151*b*, and 151*c* to form dielectric medium interfaces between the first, third, and fifth dielectric layers 151*a*, 151*b*, and 151*c*, may include a material having relatively high flexibility such as liquid crystal polymer (LCP) or polyimide, or may include materials such as an epoxy resin or Teflon to have relatively strong durability and relatively high adhesion.

The dielectric medium interface may refract a propagation direction of an RF signal to concentrate a radiation pattern formation direction of the chip antenna module 100*b* in a vertical direction (for example, a z direction).

The upper surface of the third dielectric layer 151*b* may be used as an arrangement space of the second patch antenna pattern 112*b*, and an upper surface of the fifth dielectric layer 151*c* may be used as an arrangement space of the third patch antenna pattern 113*b*.

Since the second and third patch antenna patterns 112*b* and 113*b* may be electromagnetically coupled to the first patch antenna pattern 111*b*, respectively, the first patch antenna pattern 111*b* may provide additional impedance, and a bandwidth of the first patch antenna pattern 111*b* may be further widened.

According to a design, the third patch antenna pattern 113*b* may have a slot in a central portion. Therefore, since a surface current flowing through the third patch antenna pattern 113*b* may flow in a direction rotating around the slot, a size of the third patch antenna pattern 113*b* according to optimization of wavelength of the RF signal may be smaller.

Referring to FIG. 2B, a chip antenna module 100*b* according to an example may further include a second feed via 122*b*-1 and/or 122*b*-2 and a plurality of shielding vias 145*a*.

According to a design, the second patch antenna pattern 112*b* may be configured to receive or transmit a second RF signal from the second feed via 122*b*-1 or 122*b*-2, and to remotely transmit and/or receive the second RF signal.

For example, according to a design, the second feed via 122*b*-1 or 122*b*-2 may be disposed to pass through the first dielectric layer 151*a*, may be disposed to pass through-holes of the first patch antenna pattern 111*b*, and may provide an electricity feed path for the antenna pattern 112*b*.

Referring to FIG. 3B, the plurality of shielding vias 145*a* may be arranged to pass through the first dielectric layer 151*a*, respectively, may be electrically connected to the first patch antenna pattern 111*b*, and may be arranged to surround the second feed via 122*b*-1 or 122*b*-2.

Therefore, effects of electromagnetic noise from the second feed via 122*b*-1 or 122*b*-2 that affects the first patch antenna pattern 111*b* may be reduced.

As an electrical distance between an electricity feed point of the first patch antenna pattern 111*b* and the plurality of shielding vias 145*a* is longer, energy loss in the first patch antenna pattern 111*b* may be reduced. Therefore, a gain of the first patch antenna pattern 111*b* may be improved.

The coupling pattern 130*b*-1 or 130*b*-2 may be disposed on the upper surface of the first dielectric layer 151*a*, and may be disposed to be spaced apart from the first patch antenna pattern 111*b* without overlapping the first patch antenna pattern 111*b* in the vertical direction. For example, the coupling pattern 130*b*-1 or 130*b*-2 may be disposed closer to a side surface of the first dielectric layer 151*a* than the first patch antenna pattern 111*b*.

The first feed via 121*b*-1 or 121*b*-2 may extend in the first dielectric layer 151*a* in the vertical direction (e.g., the z direction) to provide an electricity feed path for the coupling pattern 130*b*-1 or 130*b*-2.

Therefore, an effective electricity feed point of the first patch antenna pattern 111*b* may be disposed to be further spaced apart from an edge of the first patch antenna pattern 111*b* in a direction away from the plurality of shielding vias 145*a*.

Therefore, the electrical distance between the effective electricity feed point of the first patch antenna pattern 111*b* and the plurality of shield vias 145*a* may be longer, and the gain of the first patch antenna pattern 111*b* may be further improved.

The second patch antenna pattern 112*b* may be disposed so as not to overlap the coupling pattern 130*b*-1 or 130*b*-2 in the vertical direction (e.g., the z direction), and a dielectric constant of the second dielectric layer 152*b* may be lower than a dielectric constant of the first or third dielectric layer 151*a* or 151*b*.

Therefore, electromagnetic interference of the coupling pattern 130*b*-1 or 130*b*-2 for the second patch antenna patterns 112*b* according to indirect electricity feeding by the coupling pattern 130*b*-1 or 130*b*-2 of the first patch antenna pattern 111*b* may be reduced, electromagnetic isolation between the first and second patch antenna patterns 111*b* and 112*b* may be further improved, and each of the gains of the first and second patch antenna patterns 111*b* and 112*b* may be improved.

Figure 4A:
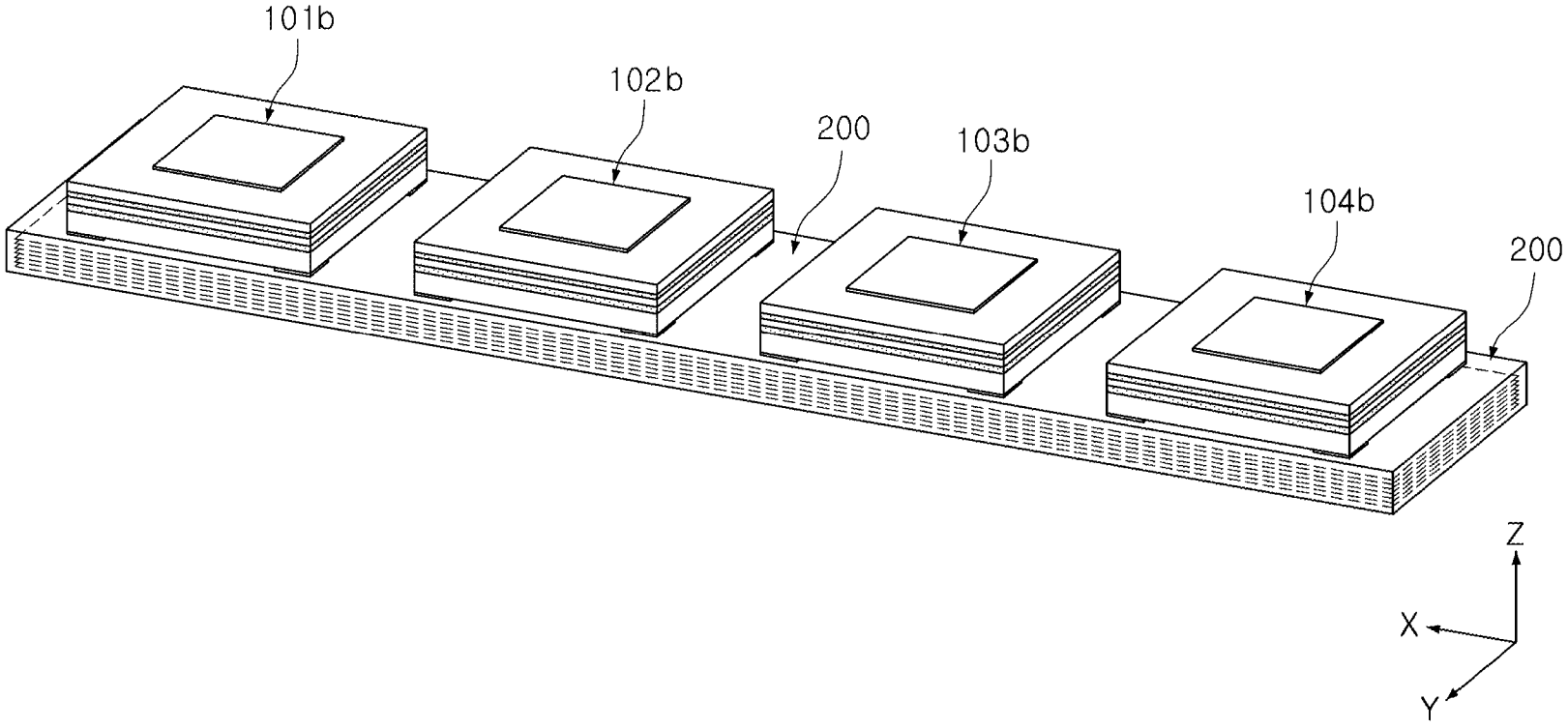
FIG. 4A is a perspective view illustrating an arrangement of chip antenna modules according to an example.
Figure 4B:
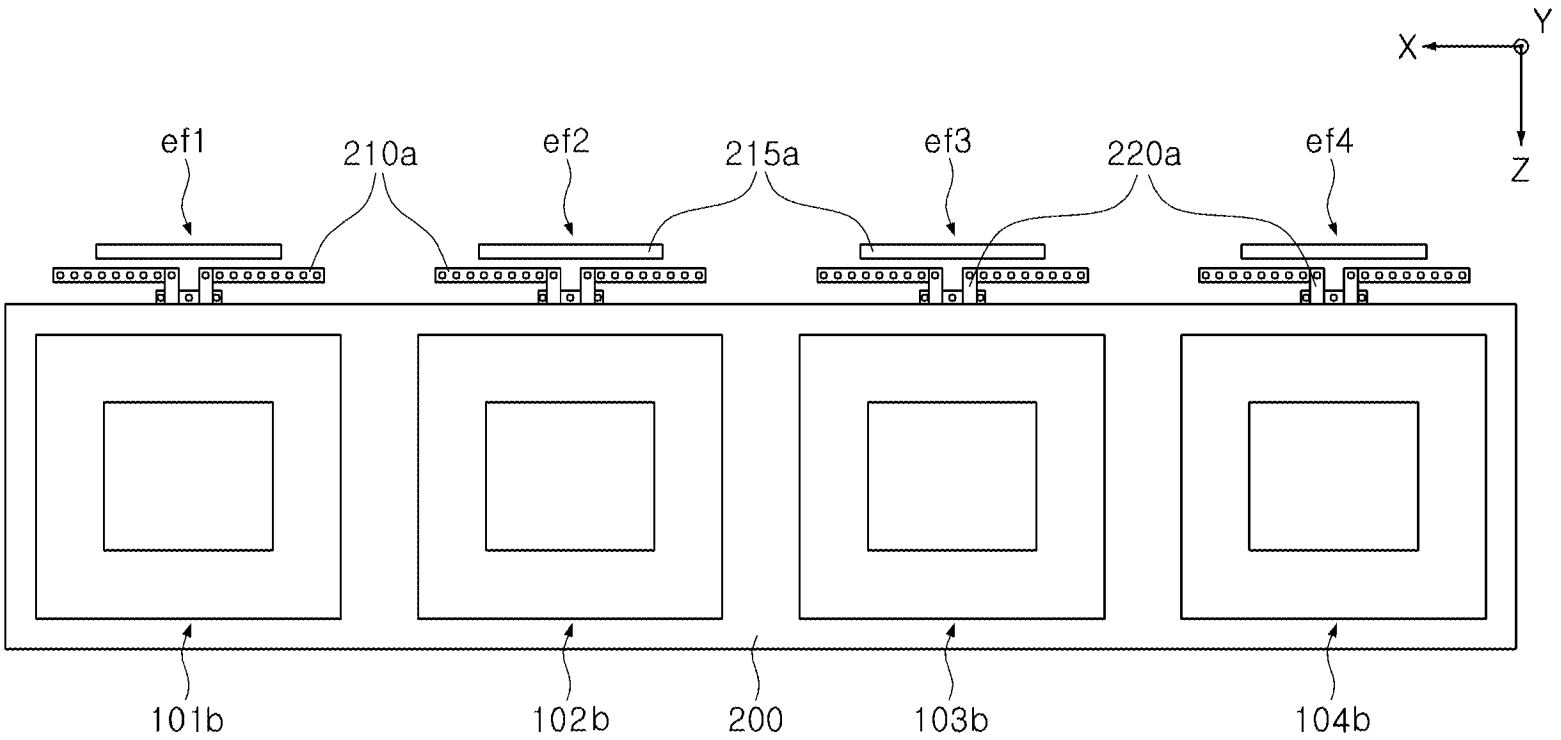
FIGS. 4B and 4C are plan views illustrating arrangements of chip antenna modules according to an examples.
Figure 4C:
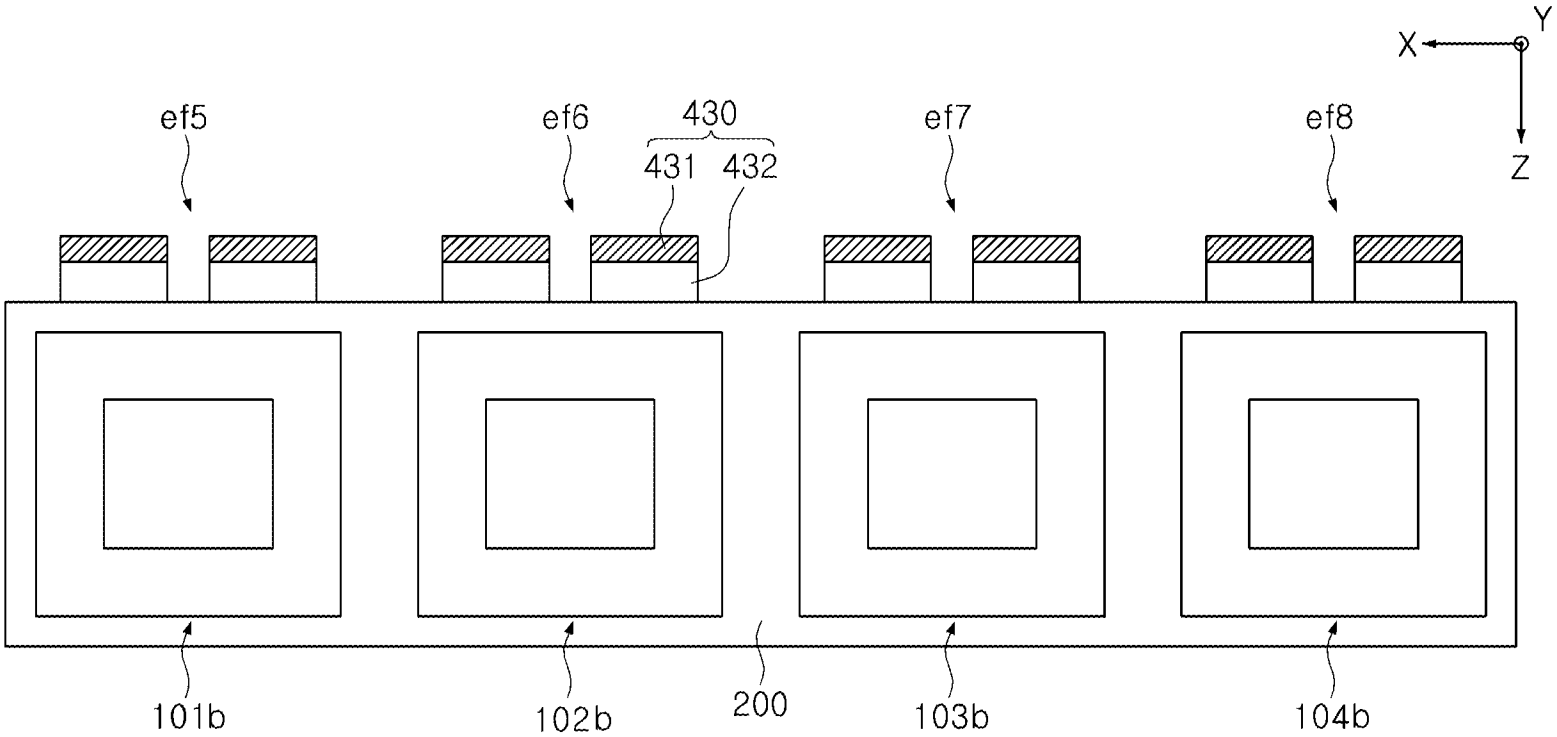

FIG. 4A is a perspective view illustrating an arrangement of chip antenna modules according to an example, and FIGS. 4B and 4C are plan views illustrating arrangements of chip antenna modules according to an example.

Referring to FIG. 4A, a plurality of chip antenna modules 101*b*, 102*b*, 103*b*, and 104*b* may be arranged side by side along the x direction on an upper surface of a connection member 200.

Referring to FIG. 4B, a connection member 200 may include a plurality of end-fire antennas ef1, ef2, ef3, and ef4 arranged in parallel to a plurality of chip antenna modules 101*b*, 102*b*, 103*b*, and 104*b*, and may form a radiation pattern of an RF signal in the horizontal direction (e.g., the x direction and/or the y direction).

The plurality of end-fire antennas ef1, ef2, ef3, and ef4 may include a plurality of end-fire antenna patterns 210*a* and a plurality of feed lines 220*a*, and may further include a director pattern 215*a*, respectively.

Referring to FIG. 4C, a connection member 200 may include a plurality of end-fire antennas ef5, ef6, ef7, and ef8 arranged in parallel to a plurality of chip antenna modules 101*b*, 102*b*, 103*b*, and 104*b*, and may thus form a radiation pattern of an RF signal in the horizontal direction.

The plurality of end-fire antennas ef5, ef6, ef7, and ef8 may be chip end-fire antennas 430 that include a radiator 431 and a dielectric 432, respectively.

Figure 5A:
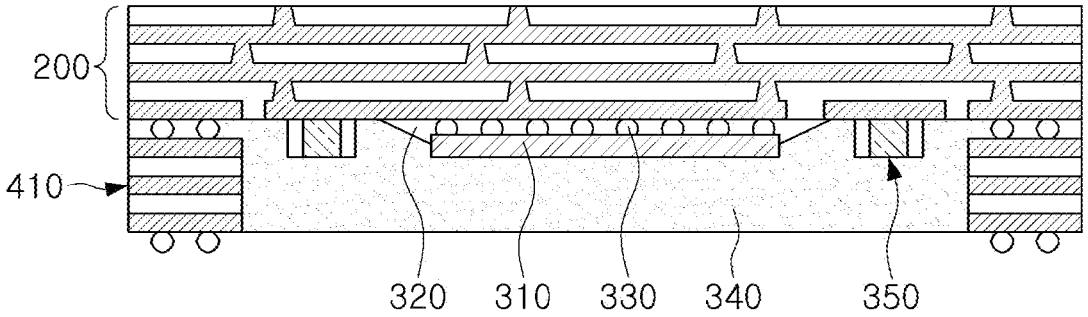
FIGS. 5A to 5B are side views illustrating lower structures of the connection members illustrated in FIGS. 4A, 4B, and 4C.
Figure 5B:
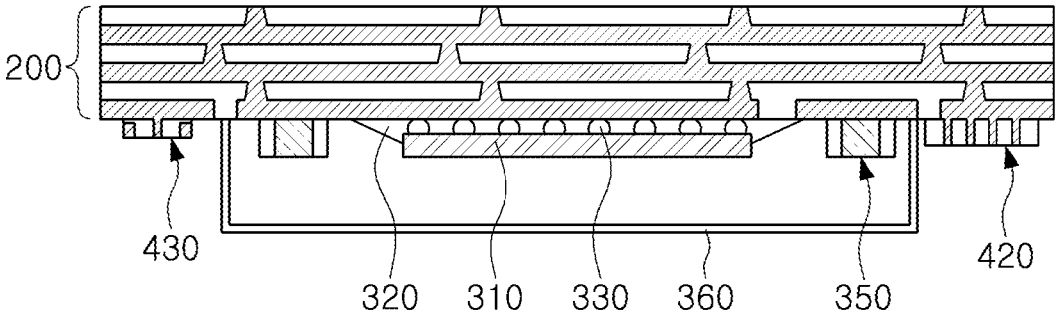

FIGS. 5A to 5B are side views illustrating lower structures of the connection members illustrated in FIGS. 4A through 4C.

Referring to FIG. 5A, a connection member 200 in which a chip antenna module according to an example is mounted may provide at least one arrangement space of an IC 310, an adhesive member 320, an electrical connection structure 330, an encapsulant 340, a passive component 350, and a core member 410.

The IC 310 may be disposed under the connection member 200, and may perform at least some of frequency conversion, amplification, filtering, phase control, and power generation on an RF signal remotely transmitted and/or received by the chip antenna module according to an embodiment of the present disclosure. The IC 310 may be electrically connected to a wiring of the connection member 200 to transmit or receive an RF signal, and may be electrically connected to a ground plane of the connection member 200, to receive ground.

The adhesive member 320 may bond the IC 310 and the connection member 200 to each other.

The electrical connection structure 330 may electrically connect the IC 310 and the connection member 200. For example, the electrical connection structure 330 may have a structure such as a solder ball, a pin, a land, and a pad. The electrical connection structure 330 may have a lower melting point than the wiring and the ground plane of the connection member 200, to electrically connect the IC 310 and the connection member 200 through a predetermined process using the lower melting point of the connection structure 330.

The encapsulant 340 may encapsulate at least a portion of the IC 310, and may improve heat dissipation performance and impact protection performance of the IC 310. For example, the encapsulant 340 may be implemented with a photo imageable encapsulant (PIE), an Ajinomoto build-up film (ABF), an epoxy molding compound (EMC), or the like.

The passive component 350 may be disposed on a lower surface of the connection member 200, and may be electrically connected to the wiring and/or the ground plane of the connection member 200 through the electrical connection structure 330. For example, the passive component 350 may include at least a portion of a capacitor (e.g., a multilayer ceramic capacitor (MLCC)), an inductor, and a chip resistor.

The core member 410 may be disposed under the connection member 200, and may be electrically connected to the connection member 200, to receive an intermediate frequency (IF) signal or a base band signal from the outside and transmit the received IF signal to the IC 310, or receive the IF signal or the baseband signal from the IC 310 to transmit the received IF signal to the outside. In this case, a frequency (e.g., 24 GHz, 28 GHz, 36 GHz, 39 GHz, or 60 GHz) of the RF signal may be greater than a frequency (e.g., 2 GHz, 5 GHz, 10 GHz, etc.) of the IF signal.

For example, the core member 410 may transmit or receive an IF signal or a baseband signal to or from the IC 310 through a wiring that may be included in the IC ground plane of the connection member 200.

Referring to FIG. 5B, a connection member 200 may include at least a portion of a shielding member 360, a connector 420, and a chip end-fire antenna 430.

The shielding member 360 may be disposed under the connection member 200 to confine the IC 310 together with the connection member 200. For example, the shielding member 360 may be arranged to cover the IC 310 and the passive component 350 together (e.g., conformal shield) or to cover each of the IC 310 and the passive component 350 (e.g., a compartment shield). For example, the shielding member 360 may have a shape of a hexahedron having one surface open, and may have a hexahedral receiving space through coupling with the connection member 200. The shielding member 360 may be made of a material having high conductivity such as copper to have a short skin depth, and may be electrically connected to the ground plane of the connection member 200. Therefore, the shielding member 360 may reduce electromagnetic noise that may be received by the IC 310 and the passive component 350.

The connector 420 may have a connection structure of a cable (e.g., a coaxial cable, a flexible PCB), may be electrically connected to the IC ground plane of the connection member 200, and may have a role similar to that of the core member 410 described above. For example, the connector 420 may receive an IF signal, a baseband signal and/or a power from a cable, or provide an IF signal and/or a baseband signal to a cable.

The chip end-fire antenna 430 may transmit or receive an RF signal in support of a chip antenna module, according to an example. For example, the chip end-fire antenna 430 may include a dielectric block having a dielectric constant greater than that of the insulating layer, and electrodes disposed on both surfaces of the dielectric block. One of the electrodes may be electrically connected to the wiring of the connection member 200, and the other of the electrodes may be electrically connected to the ground plane of the connection member 200.

Figure 6A:
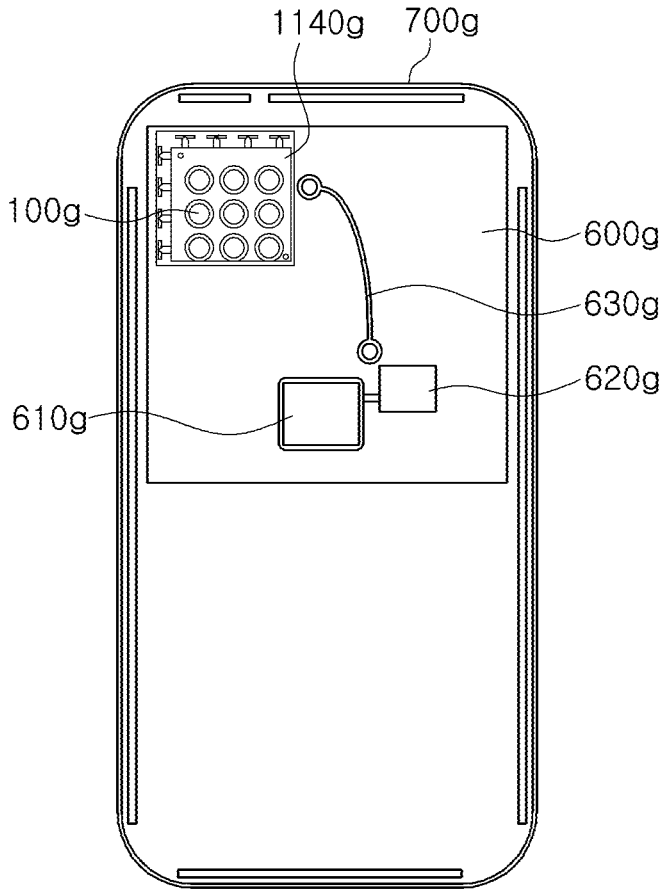
FIGS. 6A and 6B are plan views illustrating electronic devices including a chip antenna module according to an example.
Figure 6B:
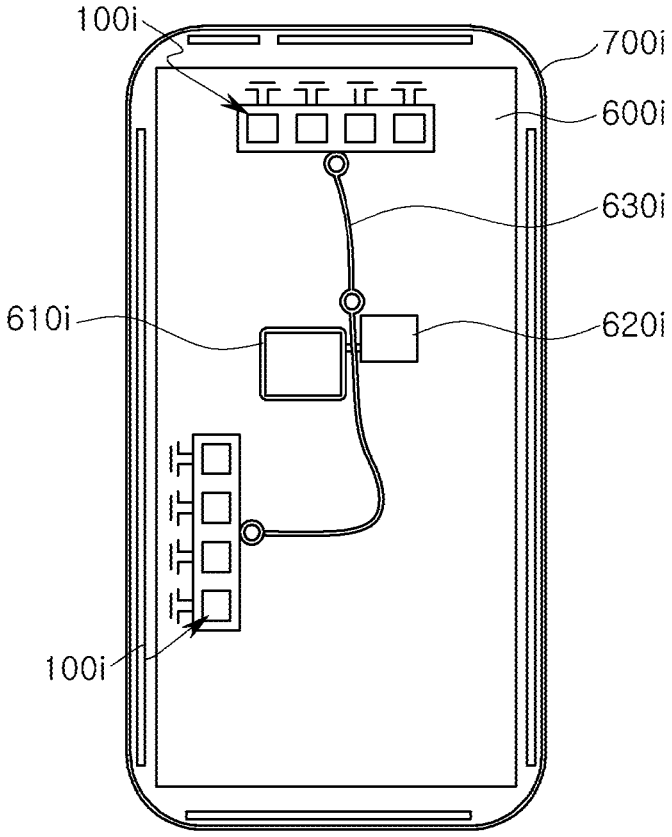

FIGS. 6A and 6B are plan views illustrating electronic devices including a chip antenna module according to an example.

Referring to FIG. 6A, a chip antenna module 100*g* may be included in an antenna apparatus disposed adjacent to a lateral boundary of an electronic device 700*g* on a set substrate 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smart watch, an automotive, or the like, but is not limited to such devices.

A communications module 610*g* and a baseband circuit 620*g* may also be disposed on the set substrate 600*g*. The chip antenna module 100*g* may be electrically connected to the communications module 610*g* and/or the baseband circuit 620*g* through a coaxial cable 630*g*.

The communications module 610*g* may include at least a portion of: a memory chip, such as a volatile memory (e.g., a DRAM), a non-volatile memory (e.g., a ROM), a flash memory, or the like; an application processor chip, such as a central processor (e.g., a CPU), a graphics processor (e.g., a GPU), a digital signal processor, a cryptographic processor, a microprocessor, a microcontroller, or the like; and a logic chip, such as an analog-to-digital converter, an application-specific IC (ASIC), or the like, to perform a digital signal process.

The baseband circuit 620*g* may perform an analog-to-digital conversion, amplification in response to an analog signal, filtering, and frequency conversion to generate a base signal. The base signal input/output from the baseband circuit 620*g* may be transferred to the chip antenna module 100*g* through a cable.

For example, the base signal may be transmitted to the IC through an electrical connection structure, a core via, and a wiring. The IC may convert the base signal into an RF signal in a millimeter wave (mmWave) band.

Referring to FIG. 6B, a plurality of connection members on which a chip antenna module 100*i* according to an example is mounted may be respectively disposed adjacent to a center of sides of the electronic device 700*i*, which has a polygonal shape, on a set substrate 600*i* of the electronic device 700*i*. A communications module 610*i* and a baseband circuit 620*i* may also be arranged on the set substrate 600*i*. The chip antenna modules may be electrically connected to the communications module 610*i* and/or the baseband circuit 620*i* through a coaxial cable 630*i*.

Referring back to FIG. 6A, a dielectric layer 1140*g* may be filled in at least a portion of a space between a plurality of chip antenna modules.

The dielectric and insulating layers disclosed herein may be implemented with a thermosetting resin such as FR4, liquid crystal polymer (LCP), low temperature co-fired ceramic (LTCC), an epoxy resin, or a thermoplastic resin such as polyimide, or a resin impregnated into core materials such as glass fiber, glass cloth and glass fabric together with inorganic filler, prepregs, Ajinomoto build-up film (ABF), FR-4, bismaleimide triazine (BT), a photoimageable dielectric (PID) resin, a copper clad laminate (CCL), a glass or ceramic based insulating material, or the like.

The pattern, via, and plane disclosed herein may include a metal material (e.g., a conductive material, such as copper (Cu), aluminum (Al), silver (Ag), tin (Sn), gold (Au), nickel (Ni), lead (Pb), titanium (Ti), alloys thereof, or the like), and may be formed according by plating methods such as a chemical vapor deposition (CVD) process, a physical vapor deposition (PVD) process, a sputtering process, a subtractive process, an additive process, a semi-additive process (SAP), a modified semi-additive process (MSAP), and or the like, but is not limited thereto.

RF signals disclosed herein may have a format according to Wi-Fi (IEEE 802.11 family, etc.), WiMAX (IEEE 802.16 family, etc.), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols designated later thereto, but are not limited thereto.

The chip antenna module according to an example may obtain a wider bandwidth compared to the overall size, and may obtain a more freely designed bandwidth.

The chip antenna module according to an example may obtain a relatively wide bandwidth, may reduce the electromagnetic interference between the first and second frequency bands, and may improve the gain.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module comprising:

a first dielectric layer;

a solder layer disposed on a first surface of the first dielectric layer;

a patch antenna pattern disposed on a second surface of the first dielectric layer;

a coupling pattern disposed on the second surface of the first dielectric layer, and spaced apart from the patch antenna pattern without overlapping the patch antenna pattern in a thickness direction of the chip antenna module;

a first feed via extending through the first dielectric layer in the thickness direction so as not to overlap the patch antenna pattern and the coupling pattern in the thickness direction;

a first feed pattern extending from a first end of the first feed via to overlap at least a portion of the coupling pattern in the thickness direction; and a second feed pattern extending from a second end of the first feed via to overlap at least a portion of the coupling pattern in the thickness direction.

2. The chip antenna module according to claim 1, wherein the coupling pattern extends in a first direction, and the first feed pattern extends from the first end of the first feed via in a second direction that is different from the first direction.

3. The chip antenna module according to claim 2, wherein the second feed pattern extends from the second end of the first feed via in the second direction.

4. The chip antenna module according to claim 2, wherein a length of the first feed pattern in the second direction is greater than a length of the coupling pattern in the first direction.

5. The chip antenna module according to claim 1, wherein the first feed pattern overlaps a portion of the patch antenna pattern in the thickness direction.

6. The chip antenna module according to claim 1, further comprising a detour pattern disposed coplanar with the second feed pattern or offset from the second feed pattern along the thickness direction, electrically connected to the second feed pattern, and having a shape that rotates around a point.

7. The chip antenna module according to claim 1, wherein the second surface of the first dielectric layer has a polygonal shape, and the patch antenna pattern has a polygonal shape in which at least some sides of the patch antenna pattern are oblique with respect to each side of the second surface of the first dielectric layer.

8. The chip antenna module according to claim 7, wherein the coupling pattern extends in a direction that is oblique with respect to each side of the second surface of the first dielectric layer.

9. The chip antenna module according to claim 7, wherein the first feed pattern extends in a direction that is oblique with respect to each side of the second surface of the first dielectric layer.

10. The chip antenna module according to claim 1, further comprising a second dielectric layer disposed on the second surface of the first dielectric layer; and a third dielectric layer disposed on a surface of the second dielectric layer opposite to the first dielectric layer, wherein the patch antenna pattern comprises:

a first patch antenna pattern disposed between the first dielectric layer and the third dielectric layer; and a second patch antenna pattern disposed on a surface of the third dielectric layer opposite to the second dielectric layer.

11. The chip antenna module according to claim 10, further comprising a second feed via that passes through the first dielectric layer and is configured to provide an electricity feed path for the second patch antenna pattern; and shielding vias that pass through the first dielectric layer, are electrically connected to the first patch antenna pattern, and surround the second feed via, wherein the first patch antenna pattern defines a through-hole through which the second feed via passes, and is fed from the first feed pattern.

12. A chip antenna module comprising:

a first dielectric layer;

a solder layer disposed on a first surface of the first dielectric layer;

a second dielectric layer disposed on a second surface of the first dielectric layer;

a third dielectric layer disposed on a surface of the second dielectric layer opposite to the first dielectric layer;

a first patch antenna pattern disposed between the first dielectric layer and the third dielectric layer, and having a through-hole;

a second patch antenna pattern disposed on a surface of the third dielectric layer opposite to the first dielectric layer;

a second feed via that passes through the first dielectric layer and through the through-hole of the first patch antenna pattern, and is configured to provide an electricity feed path to the second patch antenna pattern;

shielding vias that pass through the first dielectric layer, are electrically connected to the first patch antenna pattern, and surround the second feed via;

a coupling pattern disposed on the second surface of the first dielectric layer, and spaced apart from the first patch antenna pattern without overlapping the first patch antenna pattern in a thickness direction of the chip antenna module; and a first feed via extending through the first dielectric layer in the thickness direction, and configured to provide an electricity feed path for the coupling pattern.

13. The chip antenna module according to claim 12, wherein the coupling pattern is disposed closer to a side surface of the first dielectric layer than the first patch antenna pattern.

14. The chip antenna module according to claim 12, wherein the second surface of the first dielectric layer has a polygonal shape, the first patch antenna pattern has a polygonal shape in which at least some sides of the first patch antenna pattern are oblique with respect to each side of the second surface of the first dielectric layer, and the coupling pattern is disposed closer to a corner of the first dielectric layer than the first patch antenna pattern.

15. The chip antenna module according to claim 14, wherein the coupling pattern extends in a direction that is oblique with respect to each side of the second surface of the first dielectric layer.

16. The chip antenna module according to claim 12, wherein the coupling pattern does not to overlap the second patch antenna pattern in the thickness direction, and a dielectric constant of the second dielectric layer is lower than a dielectric constant of the first dielectric layer and a dielectric constant of the third dielectric layer.

* * * * *